United States Patent [19]

Hall

[11] Patent Number: 4,853,728

[45] Date of Patent: Aug. 1, 1989

[54] X-RAY FILM PROCESSOR RACK

[75] Inventor: Douglas O. Hall, Farmington, N.Y.

[73] Assignee: Eastman Kodak Company, Rochester, N.Y.

[21] Appl. No.: 149,795

[22] Filed: Jan. 29, 1988

[51] Int. Cl.[4] ..... G03D 3/13

[52] U.S. Cl. ..... 354/320; 354/322; 226/189

[58] Field of Search ..... 354/320, 321, 322, 297, 354/319; 226/91, 189; 271/314, 315

[56] References Cited

U.S. PATENT DOCUMENTS

| | | | |
|---|---|---|---|
| 3,072,310 | 1/1963 | Kunz | 226/189 |
| 4,002,280 | 1/1977 | Coleman et al. | 354/319 |
| 4,034,389 | 7/1977 | Huss | 354/320 |
| 4,118,998 | 10/1978 | Hope et al. | 354/321 |
| 4,307,831 | 12/1981 | Hope et al. | 226/189 |

*Primary Examiner*—A. A. Mathews

*Attorney, Agent, or Firm*—Roger A. Fields

[57] ABSTRACT

A method of achieving an optimal balance of wrap angle, strike angle, and film driving force parameters in a roller transport film processor, and a film processor so constructed, are disclosed. Purposes are to optimize performance and to eliminate or attenuate pi line artifacts on processed film. The method includes the following steps: (a) determining empirically a relationship of strike angle as a function of wrap angle; (b) determining empirically a relationship of film driving force as a function of wrap angle; (c) preselecting a maximum allowable strike angle; (d) from the relationship of strike angle to wrap angle, determining a maximum allowable wrap angle corresponding to the maximum allowable strike angle; (e) preselecting a minimum practical wrap angle corresponding to a minimum practical film driving force; and (f) establishing horizontal centerline distances between rollers in the film processor to achieve a wrap angle between the maximum allowable wrap angle and the minimum practical wrap angle. By this method, functional ranges of wrap angle, strike angle, and film driving force parameters are defined. Within these ranges, a roller transport film processor is operable without resulting pi line artifacts.

3 Claims, 2 Drawing Sheets

X-RAY FILM PROCESSOR RACK

BACKGROUND OF THE INVENTION

1. Field of the Invention

This invention relates to an x-ray film processor, and more specifically to a roller film transport system for such a processor.

2. Description of the Prior Art

Unlike ordinary photographic film which is usually used and processed in strip form, x-ray film is ordinarily used and processed in separate sheets with a single frame per sheet. Processing of x-ray film typically involves movement of the film in a sinuous path through an array of rollers immersed in developing, fixing, or rinsing liquid. The rollers both guide the film through the sinuous path and press the liquid from the film somewhat in the manner of a squeegee.

In such a roller transport processor, a surface artifact generally occurs on a developing x-ray film as a line parallel to the leading edge. With rollers of 1 inch diameter, this line is 3.15 inches in from the leading edge of the film. The distance 3.15 inches is one circumference, or $\pi$ times the diameter of the roller, hence this line artifact is sometimes known as a "pi line". A pi line is not a defect of the film emulsion, but a deposit of particles onto the surface of the film. They can occur on either or both sides of the film, and are subject to smearing if there is slippage between rollers and film.

The deposition of particles is from the rollers onto the surface of the film. This deposition occurs in all three racks of a film processor; the developer rack, the fixer rack, and the wash rack. These particles accumulate on the rollers as a result of the chemistry in each of the racks. Particles deposit on the film because the leading edge of the film, when striking a roller, dislodges a line of particles to form a concentrated line of these particles directly in front of the film leading edge. In plain language, this may be visualized as analogous to a straight gouge, formed by an abutting straight edge, leaving displaced material in a straight mound alongside the gouge. This concentrated line or bead or loose particles remains on the roller for one roller revolution. At one revolution, when this bead of particles makes contact with the film, some particles are transferred to the film while some remain with the roller. While it is possible that such a deposition of particles from only one roller would be sufficient to make a pi line visible to the human eye, this seems unlikely. It is rather the repetition of these depositions by repeated abutments of the film leading edge on successive rollers, each such roller depositing particles on the film along the same line, that creates a visible pi line.

The quantity of particles in the chemistry increases in proportion to the number of films that are processed in it. For this reason, visible pi lines appear after a period of equipment use, and they increase in density over time as more films are processed. The current practice for avoiding pi lines, especially in industrial processors since they run at lower transport speeds than medical processors, is to clean the racks frequently and thoroughly. Some industrial processors incorporate a buffer roller in the final wash rack to wash off pi lines. It is an object of this invention to provide means to avoid or reduce pi line artifacts heretofore inherent in x-ray film processing.

SUMMARY OF THE INVENTION

The invention may be summarized as a method of achieving an optimal balance of wrap angle, strike angle, and film driving force parameters in a roller transport film processor to optimize its performance and to eliminate or attenuate pi line artifacts on processed film. The method includes the following steps: (a) determining empirically a relationship of strike angle as a function of wrap angle; (b) determining empirically a relationship of film driving force as a function of wrap angle; (c) preselecting a maximum allowable strike angle; (d) from the relationship of strike angle to wrap angle, determining a maximum allowable wrap angle corresponding to the maximum allowable strike angle; (e) preselecting a minimum practical wrap angle corresponding to a minimum practical film driving force; and (f) establishing horizontal centerline distances between rollers in the film processor to achieve a wrap angle between the maximum allowable wrap angle and the minimum practical wrap angle. By this method, functional ranges of wrap angle, strike angle, and film driving force parameters are defined. Within these ranges, a roller transport film processor is operable without resulting pi line artifacts. The invention also includes a roller transport film processor so constructed.

DESCRIPTION OF THE PREFERRED EMBODIMENT

Figure 1:
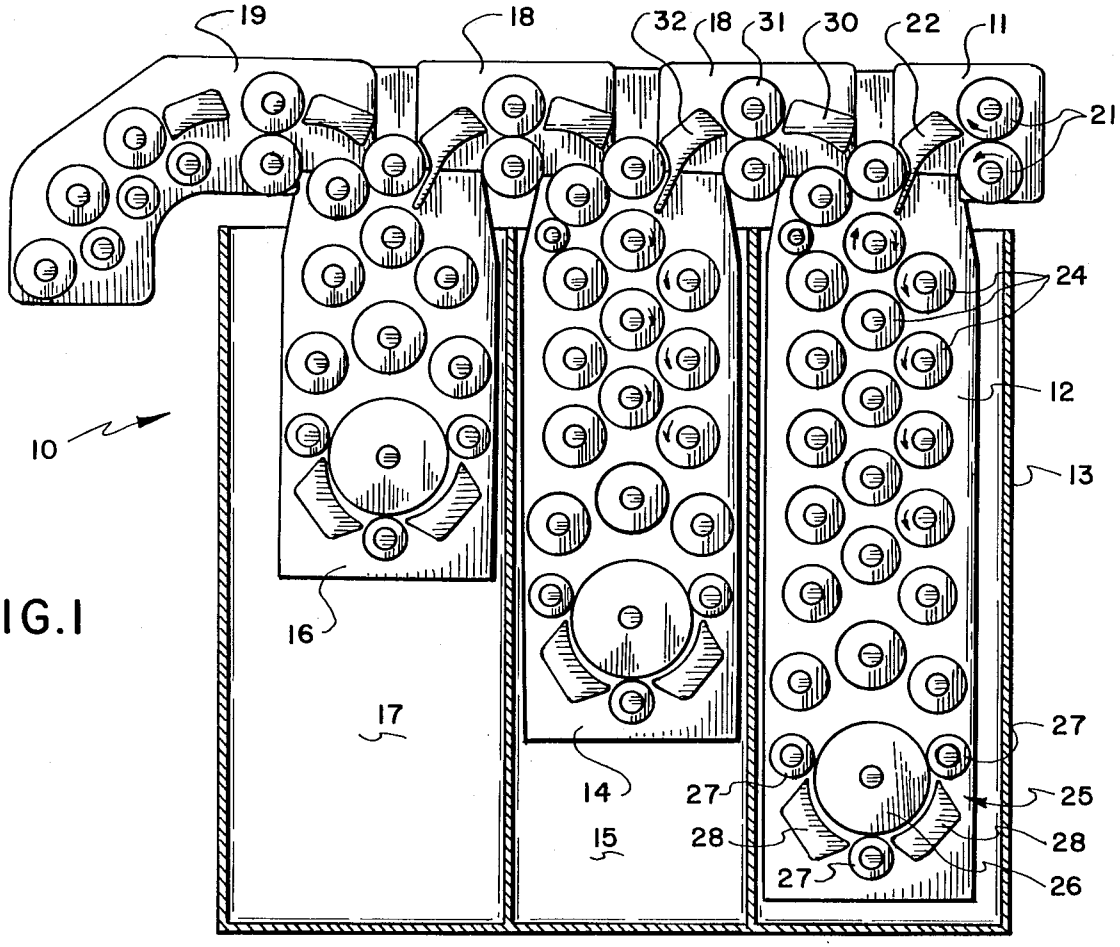
FIG. 1 is a side elevation view of the racks of an x-ray film processor.

Referring now to FIG. 1, the working members of a roller transport film processor are shown in side elevation view without tanks. They include an entrance roller assembly 11, a developer rack 12 extending into a developer tank 13, a fixer rack 14 extending into a fixer tank 15, and a wash rack 16 extending into a wash tank 17. Crossover members 18 connect the developer rack 12 with the fixer rack 14, and the fixer rack 14 with the wash rack 16. An exit roller assembly 19 completes the film path through the processor. The entrance roller assembly 11, developer rack 12, and the first crossover 18 are shown in detail, and are representative of the others which are shown only in outline. Developer tank 13 contains developing liquid, fixer tank 15 contains fixing liquid, and wash tank 17 contains washing liquid.

The enctrance roller 11 includes an opposed pair of rotatable feed rollers 21 and a guide shoe 22 to feed and guide a film sheet into the developer rack 12. Crossover member 18 includes a guide shoe 30, an opposed pair of crossover rollers 31, and a guide shoe 32 to convey the moving film from the developer rack 12 into the fixer rack 14.

Rack 12 includes a plurality of rack rollers 24 in an array such as to define the film path through the rack. The film path in rack 12, as in the other racks 14 and 16, is first downward from the entrance guide shoe 22, then upward to the crossover guide shoe 30 in crossover member 18, as indicated by arrows spaced therealong in FIG. 1. Furthermore, the film moves in a sinuous path within the larger downward and upward film path defined by the rack rollers 24. At the lower end of rack 12, a turnaround assembly 25 includes a master roller 26, a plurality of cluster rollers 27 spaced around the master roller, and a pair of guide shoes 28, one on each side of the lowermost cluster roller 27.

All of the rollers are interconnected for positive rotation at the same surface speed. Feed rollers 21, rack rollers 24, and crossover rollers 31 (and like elements further along the film path) are of the same size, 1 inch in diameter for example.

Figure 2:
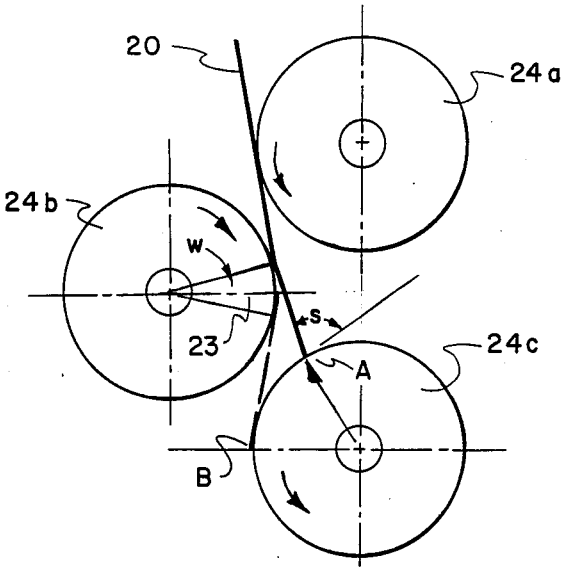
FIG. 2 is a detail from FIG. 1.

Referring now to FIG. 2, three of the rack rollers 24 are shown enlarged and individually designated as rollers **24*a*, 24*b*, and 24*c*. As a film sheet 20 moves along its sinuous path among the rack rollers 24, the leading edge of the film sheet contacts or abuts each roller (such as 24*c*) at a point of contact A and at a "strike angle" S, the angle between the film path and a line tangent to the roller at contact point A. When the leading edge of the film sheet reaches a further point B on roller 24*c* (indicated in phantom), the film sheet has reached its maximum of surface contact, through a "wrap angle" W on the preceding roller 24*b*. The wrap angle W extends equally above and below a horizontal line 23 through the center of roller 24*b***. Wrap angle W and the stiffness of the film provide a normal force between a roller and the film which, together with the surface friction characteristics of the materials, determine the resulting film driving force as:

$$F_D = \mu N$$

where:

$F_D$=driving force, $\mu$=film roller coefficient of friction, and

N=normal force between roller and film.

Film driving force increases with wrap angle, and is maximized by a maximum wrap angle. Indeed, the ultimate frictional engagement would be achieved with a wrap angle of 360°, but of course this is not possible. On the other hand, pi line artifacts would be eliminated if strike angle and wrap angle were zero, but in that event there would be no real contact of film on the rollers and therefore no driving force. Between these opposing and impractical extremes, a functional range of parameters or "window" of parameters exists in which practical results are achieved. Within this window, an optimal balance of the several parameters is found.

To find the functional range in a roller film transport, the forces resistive of film transport must be found. The resistive forces originate in two areas: the film contact against each roller, and the film contact against each guide shoe. The resistive forces are affected by the rigidity of the film sheet, the strike angle and coefficient of friction between the film and the various rollers, and the strike angle and coefficient of friction between the film and the guide shoes. Other parameters that affect film drive and film strike angle, and which may be manipulated, are roller diameter, horizontal roller distance, and vertical roller distance.

With the foregoing as a basis, and using both analytical and empirical data generated by extensive testing, I have eliminated pi line artifacts from processed x-ray film sheets by manipulation of the horizontal centerline distance of the rollers in a processing rack, and thus the strike angle of the film, to achieve a balanced, resonant, or optimum operating condition.

Figure 3:
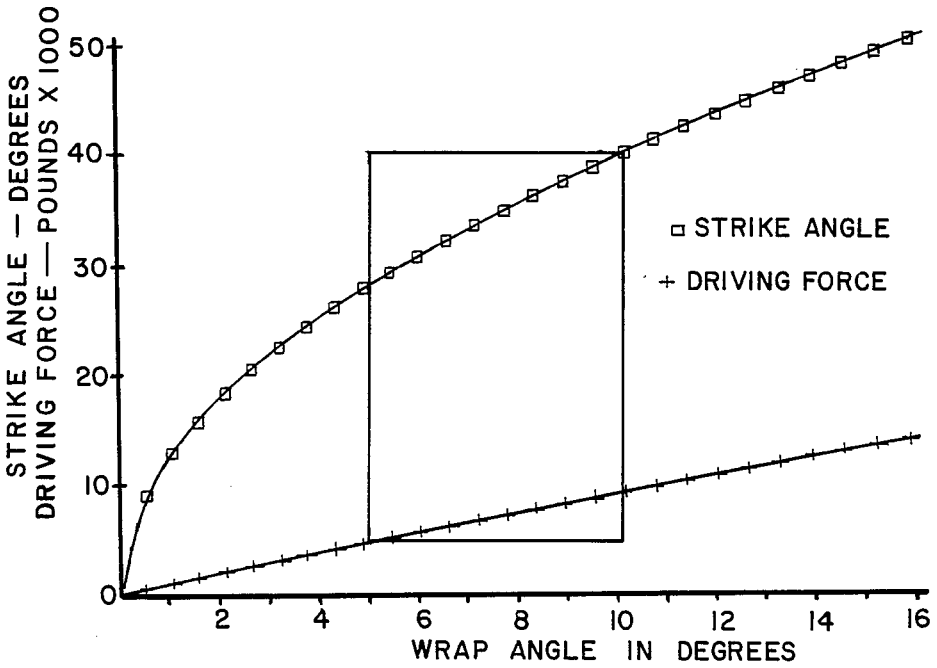
FIG. 3 is a graph showing the relationship of certain parameters in the configuration of the x-ray film processor of FIGS. 1 and 2.

FIG. 3 is a graph in which strike angle and driving force are plotted as functions of wrap angle, showing their interrelationship in the configuration of the x-ray film processor. FIG. 3 illustrates the characteristics of a film and roller transport in which the film-roller coefficient of friction $\mu=0.027$ and film modulus of elasticity$=6.8\times10^5$. Similar graphs can be generated for any film and roller combination, once the film and roller characteristics are known. The actual roller transport configuration can be derived from knowing the driving force.

In FIG. 3, the upper "strike angle" curve is a plot of strike angle (on the ordinate) as a function of wrap angle (on the abscissa). The lower "driving force" curve is a plot of driving force (ordinate) as a function of wrap angle (abscissa). Two limiting values were "superimposed" on these curves from which to determine the boundaries of the functional window. A strike angle of 40° was selected as the maximum allowable, in order to keep pi lines from becoming visible. This value establishes the upper horizontal window boundary Where the strike angle curve reaches that 40° limit, the right vertical window boundary and corresponding maximum wrap angle are determined. A wrap angle of 5° was selected as the minimum angle required to provide a practical film driving force. This value establishes the left vertical window boundary. Where the driving force curve reaches that threshold level, the lower horizontal window boundary and corresponding minimum driving force are determined. The four rectilinear boundaries of the parameter window are thus determined, this window being the functional range of the wrap angle, strike angle, and driving force parameters.

It will be seen that, in the example represented, a roller transport having a wrap angle of between 5° and approximately 10° (the two vertical window boundaries) is a functional system, free of pi lines. In this example, and in any window, the optimum configuration would be represented by a vertical line through the center of the window.

The invention has been described with reference to a preferred embodiment. However, it will be appreciated that variations and modifications can be effected within the ordinary skill in the art without departing from the scope of the invention.

In the following claims, the sequence of method steps is not critical, except as it may be dictated by practical considerations. It is intended to include all practical sequences within the scope of the claims. To include all possible sequences expressly in the claims would unduly multiply their number.

What is claimed is:

1. A method of achieving an optimal balance of wrap angle, strike angle, and film driving force parameters in a roller transport film processor to optimize the performance thereof and to attenuate pi line artifacts on film processed therein, including the steps of:

(a) determining empirically a relationship of strike angle as a function of wrap angle;

(b) determining empirically a relationship of film driving force as a function of wrap angle;

(c) preselecting a maximum allowable strike angle;

(d) from the relationship of strike angle to wrap angle, determining a maximum allowable wrap angle corresponding to said maximum allowable strike angle;

(e) preselecting a minimum practical wrap angle corresponding to a minimum practical film driving force; and (f) establishing horizontal centerline distances between rollers in said roller transport film processor to achieve a wrap angle between said maximum allowable wrap angle and said minimum practical wrap angle.

2. A method of achieving an optimal balance of wrap angle, strike angle, and film driving force parameters in a roller transport film processor to optimize the performance thereof and to attenuate pi line artifacts on film processed therein, including the steps of:

(a) determining empirically a relationship of film driving force as a function of wrap angle;

(b) determining empirically a relationship of strike angle as a function of wrap angle;

(c) preselecting a minimum practical wrap angle corresponding to a minimum practical film driving force;

(d) preselecting a maximum allowable strike angle;

(e) from the relationship of strike angle to wrap angle, determining a maximum allowable wrap angle corresponding to said maximum allowable strike angle; and (f) establishing horizontal centerline distances between rollers in said roller transport film processor to achieve a wrap angle between said maximum allowable wrap angle and said minimum practical wrap angle.

3. A roller transport film processor including a plurality of rack rollers for transport of a film sheet along a sinuous path therethrough, the leading edge of said film sheet making initial contact with each said rack roller at a strike angle s relative to the tangent to said rack roller at the point of said initial contact, each of said rack rollers making driving engagement with said film sheet through a wrap angle w, said processor including an optimal balance of wrap angle, strike angle, and film driving force parameters to optimize the performance of said processor and to attenuate pi line artifacts on film processed therein is achieved by:

(a) determining empirically a relationship of strike angle as a function of wrap angle;

(b) determining empirically a relationship of film driving force as a function of wrap angle;

(c) preselecting a maximum allowable strike angle;

(d) from the relationship of strike angle to wrap angle, determining a maximum allowable wrap angle corresponding to said maximum allowable strike angle;

(e) preselecting a minimum practical wrap angle corresponding to a minimum practical film driving force; and (f) establishing horizontal centerline distances between rollers in said roller transport film processor to achieve a wrap angle between said maximum allowable wrap angle and said minimum practical wrap angle.

* * * * *